US007547993B2

(12) United States Patent
Gresham

(10) Patent No.: US 7,547,993 B2
(45) Date of Patent: Jun. 16, 2009

(54) RADIOFREQUENCY DOUBLE POLE SINGLE THROW SWITCH

(75) Inventor: Robert Ian Gresham, Somerville, MA (US)

(73) Assignee: Autoliv ASP, Inc., Ogden, UT (US)

( * ) Notice: Subject to any disclaimer, the term of this patent is extended or adjusted under 35 U.S.C. 154(b) by 398 days.

(21) Appl. No.: 10/621,147

(22) Filed: Jul. 16, 2003

(65) Prior Publication Data

US 2005/0012400 A1 Jan. 20, 2005

(51) Int. Cl.
*H01H 31/10* (2006.01)

(52) U.S. Cl. ..... 307/115; 327/65; 327/408

(58) Field of Classification Search ..... 307/112, 307/115; 330/51, 112, 252, 254; 327/407, 327/408, 357, 65; 370/357, 359, 360, 278; 332/103

See application file for complete search history.

(56) References Cited

U.S. PATENT DOCUMENTS 3,798,376 A * 3/1974 Limberg ..... 381/4
4,460,873 A * 7/1984 Hester ..... 330/259
4,982,119 A * 1/1991 Tateishi ..... 327/65
5,396,131 A * 3/1995 Miki et al. ..... 327/65
5,448,772 A * 9/1995 Grandfield ..... 455/333
5,487,048 A * 1/1996 McClure ..... 365/207
5,510,734 A * 4/1996 Sone ..... 327/65
5,652,543 A * 7/1997 Fenk et al. ..... 330/51
5,901,350 A * 5/1999 Stoichita et al. ..... 455/321
5,977,827 A * 11/1999 Dick ..... 330/252
6,054,889 A * 4/2000 Kobayashi ..... 327/357
6,073,002 A 6/2000 Peterson ..... 455/326
6,114,921 A * 9/2000 Aoki ..... 332/103
6,137,852 A * 10/2000 McGinn et al. ..... 375/375
6,157,257 A 12/2000 Murphy ..... 330/252
6,163,215 A * 12/2000 Shibata et al. ..... 330/254
6,188,339 B1 * 2/2001 Hasegawa ..... 341/101
6,393,260 B1 5/2002 Murtojärvi et al. ..... 455/91
6,433,647 B1 * 8/2002 Filoramo et al. ..... 332/103
6,466,064 B2 * 10/2002 Kurogouchi et al. ..... 327/113
6,518,842 B1 2/2003 Carter et al. ..... 330/257
6,573,760 B1 * 6/2003 Gabara ..... 327/65
6,642,878 B2 * 11/2003 Libove et al. ..... 341/144
6,680,625 B1 * 1/2004 Lee et al. ..... 326/115
6,784,743 B2 * 8/2004 Taniguchi et al. ..... 330/285
6,819,201 B2 * 11/2004 Jain ..... 333/104
6,940,352 B2 * 9/2005 Bhattacharjee et al. ..... 330/254

(Continued)

FOREIGN PATENT DOCUMENTS

DE 4235909 A1 * 4/1994

(Continued)

*Primary Examiner*—Albert W Paladini
*Assistant Examiner*—Daniel Cavallari
(74) *Attorney, Agent, or Firm*—Sally J Brown; Kacvinsky, LLC

(57) ABSTRACT

A double pole single throw (DPST) switch circuit including a first circuit portion corresponding to a first input port, a second circuit portion corresponding to a second input port, and an output port, wherein each of the first and second circuit portions include at least one first transistor providing a portion of an isolation channel, at least one second transistor providing a portion of a transmit channel, and at least one third transistor for providing a control bias for selecting either the transmit channel or the isolation channel.

10 Claims, 7 Drawing Sheets

U.S. PATENT DOCUMENTS

| | | | | |
|---|---|---|---|---|
| 6,987,419 | B2 * | 1/2006 | Gresham | 330/254 |
| 7,123,074 | B2 * | 10/2006 | Neumann | 327/407 |
| 7,386,290 | B2 * | 6/2008 | Li et al. | 455/293 |
| 2002/0113640 | A1 * | 8/2002 | Jenkins | 327/408 |
| 2002/0125924 | A1 | 9/2002 | Kurogouchi et al. | 327/119 |
| 2003/0001677 | A1 | 1/2003 | Taniguchi et al. | 330/285 |
| 2004/0263236 | A1 * | 12/2004 | Morf et al. | 327/407 |

FOREIGN PATENT DOCUMENTS

| | | | |
|---|---|---|---|
| JP | 58-181310 | | 10/1983 |
| JP | 2001274707 | A * | 10/2001 |

* cited by examiner

RADIOFREQUENCY DOUBLE POLE SINGLE THROW SWITCH

RELATED APPLICATIONS

This present application relates to commonly-assigned U.S. patent application Ser. No. 10/614,495, filed Jul. 7, 2003, now U.S. Pat. No. 6,987,419, issued on Jan. 17, 2006.

FIELD OF THE INVENTION

This present invention relates to radiofrequency switches, and in particular, to microwave/millimeter wave switches.

BACKGROUND OF THE INVENTION

Many applications require Double Pole Single Throw (DPST) switches that will direct one of two inputs to a single output upon the application of a particular control signal. FIG. 1 shows a monopulse-type radar receiver 10, which is one example of an application which requires a DPST switch. The radar receiver 10 includes first and second reception antennae 20, 30 which are coupled to the two inputs of the DPST switch 50 through low-noise amplifiers (LNAs) 40, 45. The DPST switch 50 is used to select between one of the two reception antennae 20, 30, and thus select one of two received signals. The output of the DPST switch 50 is coupled to mixers 60, 65 which separate the received signal into in-phase (I) and quadrature phase (Q) components.

Conventionally, DPST switches operating at microwave and millimeter wave frequencies include complex networks based upon diodes and transmission lines than can be large and expensive.

Thus, there is presently a need for a DPST switch which operates at microwave and millimeter wave frequencies, but is small in size and inexpensive.

SUMMARY OF THE INVENTION

An exemplary embodiment of the present invention comprises a switch circuit including a first circuit portion corresponding to a first input port, a second circuit portion corresponding to a second input port, and an output port, wherein each of the first and second circuit portions include at least one first transistor providing a portion of an isolation channel, at least one second transistor providing a portion of a transmit channel, and at least one third transistor for providing a control bias for selecting either the transmit channel or the isolation channel.

An exemplary embodiment of the present invention also comprises a method for providing isolation between at least two inputs and an output of a switch circuit including the steps of providing a first channel for each of the at least two inputs including at least one first differential amplifier pair, said first channel providing isolation between the at least two inputs and the output of the switch circuit, providing a second channel for each of the at least two inputs including at least one second differential amplifier pair, said second channel providing coupling between the input and output of the circuit, and providing a control bias which selects one of the at least two inputs and a respective first channel or second channel.

BRIEF DESCRIPTION OF THE DRAWINGS

FIG. 2(*b*) shows the Double Pole Single Throw switch circuit of FIG. 2(*a*) in more detail.

DETAILED DESCRIPTION

Embodiments of the present invention comprises a Double Pole Single Throw (DPST) switch which may be fabricated as an integrated circuit (IC).

Figure 4:
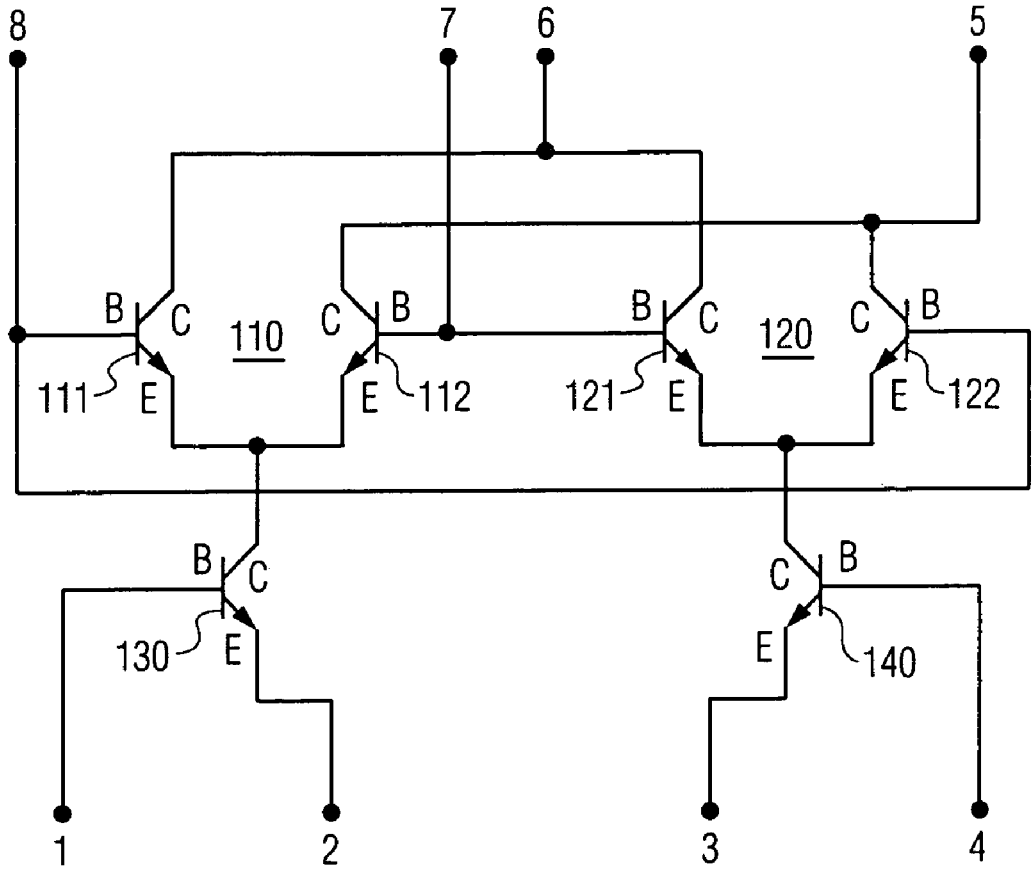
FIG. 4 PRIOR ART
FIG. 4 shows a schematic diagram of a conventional Gilbert Cell.

One conventional technique for multiplying two signals together in an IC is through the use of a Gilbert Cell. As is well known in the art, a Gilbert Cell is typically implemented as a cross-coupled differential amplifier. FIG. 4 shows an exemplary Gilbert Cell 100 which includes a first differential amplifier pair 110 (including transistors 111, 112), and a second differential amplifier pair 120 (including transistors 121, 122). The collectors of transistors 111 and 121 are coupled to each other and to pin "5" of the Gilbert Cell 100. Similarly, the collectors of transistors 112 and 122 are coupled to each other and to pin "6" of the Gilbert Cell 100. Further, the bases of transistors 111 and 122 are coupled to each other and to pin "8" of the Gilbert Cell 100, and the bases of transistors 112 and 121 are coupled to each other and to pin "7" of the Gilbert Cell. Finally, the emitters of the transistors 111, 112 of the first differential amplifier pair 110 are coupled to the collector of a first bias transistor 130, and the emitters of the transistors 121, 122 of the second differential amplifier pair 120 are coupled to the collector of a second bias transistor 140. In operation, a differential AC bias voltage applied to the bases of the first and second bias transistors 130, 140 (through pins "1" and "4" of the Gilbert Cell) controls the amplitude of an input radiofrequency (RF) signal applied across pins "6" and "7" of the Gilbert Cell. As shown and described in the following figures, the present inventors propose various modifications of a Gilbert Cell so that it may be used as a DPST switch, as opposed to its traditional use as an amplifier.

Figure 1:
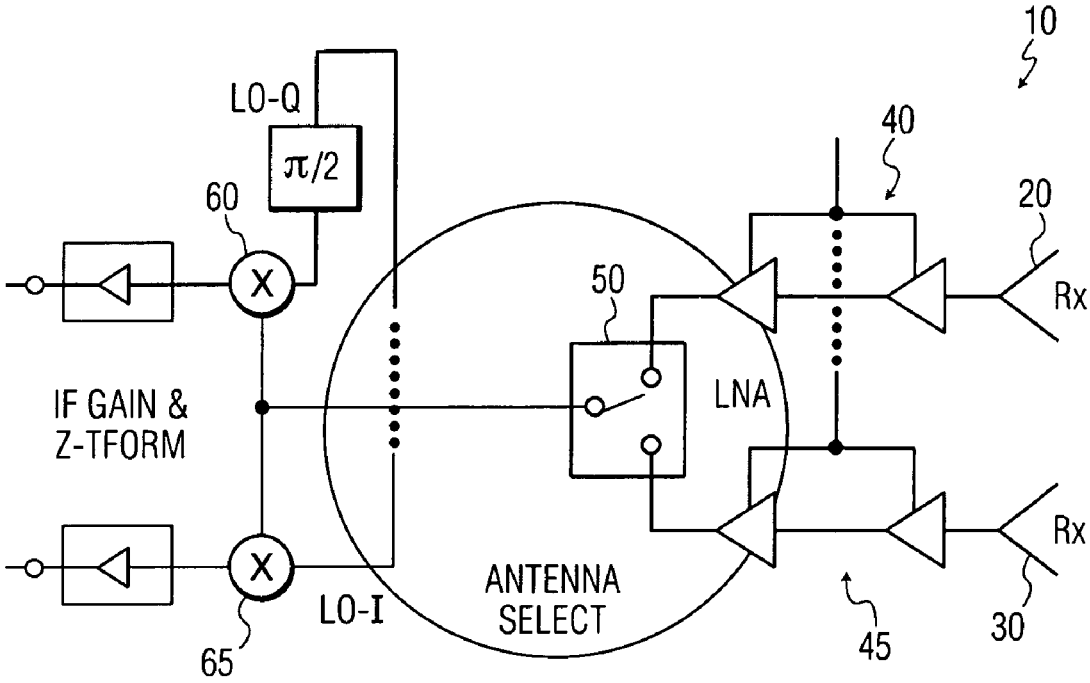
FIG. 1 PRIOR ART
FIG. 1 shows a conventional monopulse-type radar receiver.
Figure 2A:
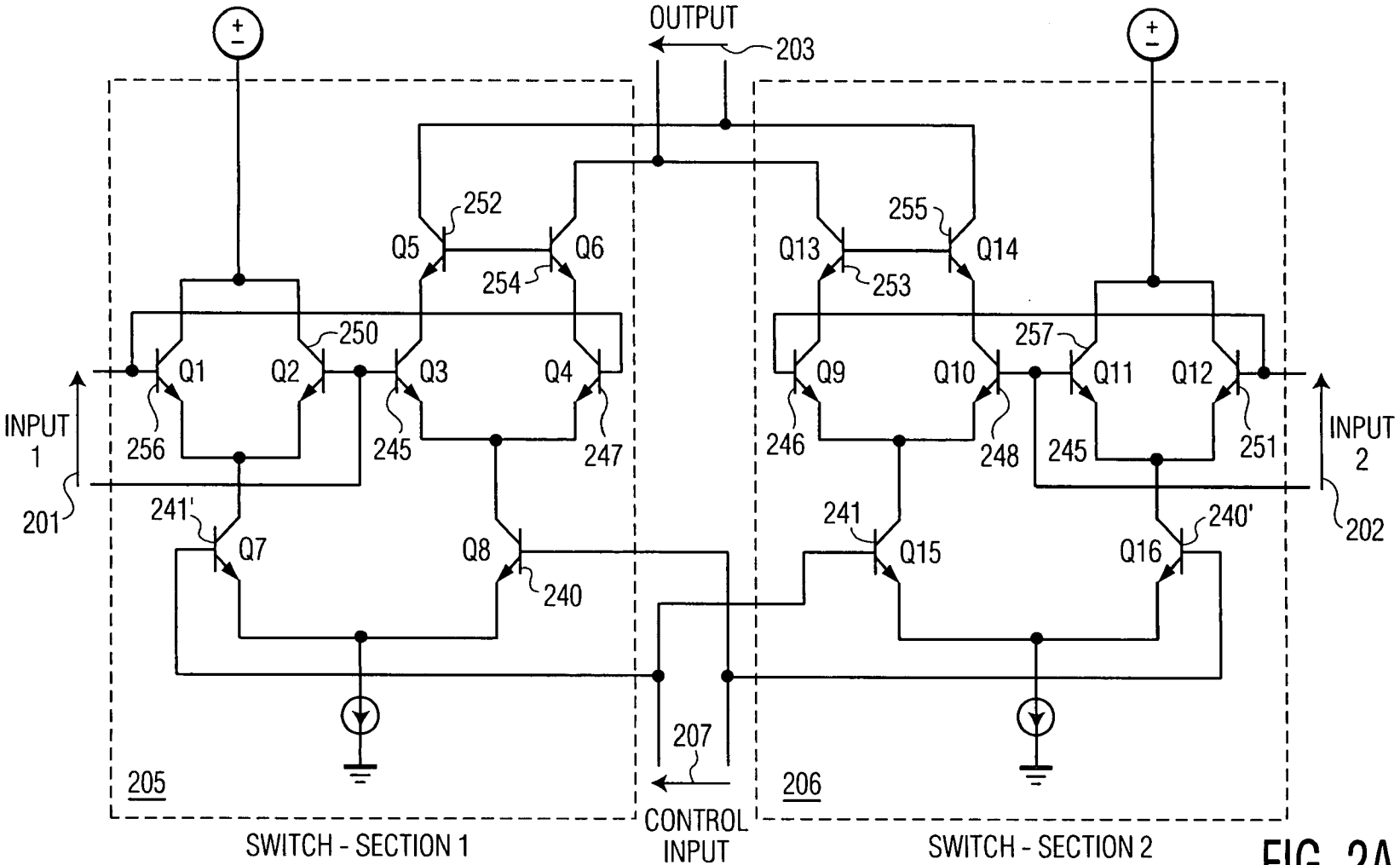
FIG. 2(*a*) shows a Double Pole Single Throw switch circuit according to a first exemplary embodiment of the present invention.
Figure 2B:
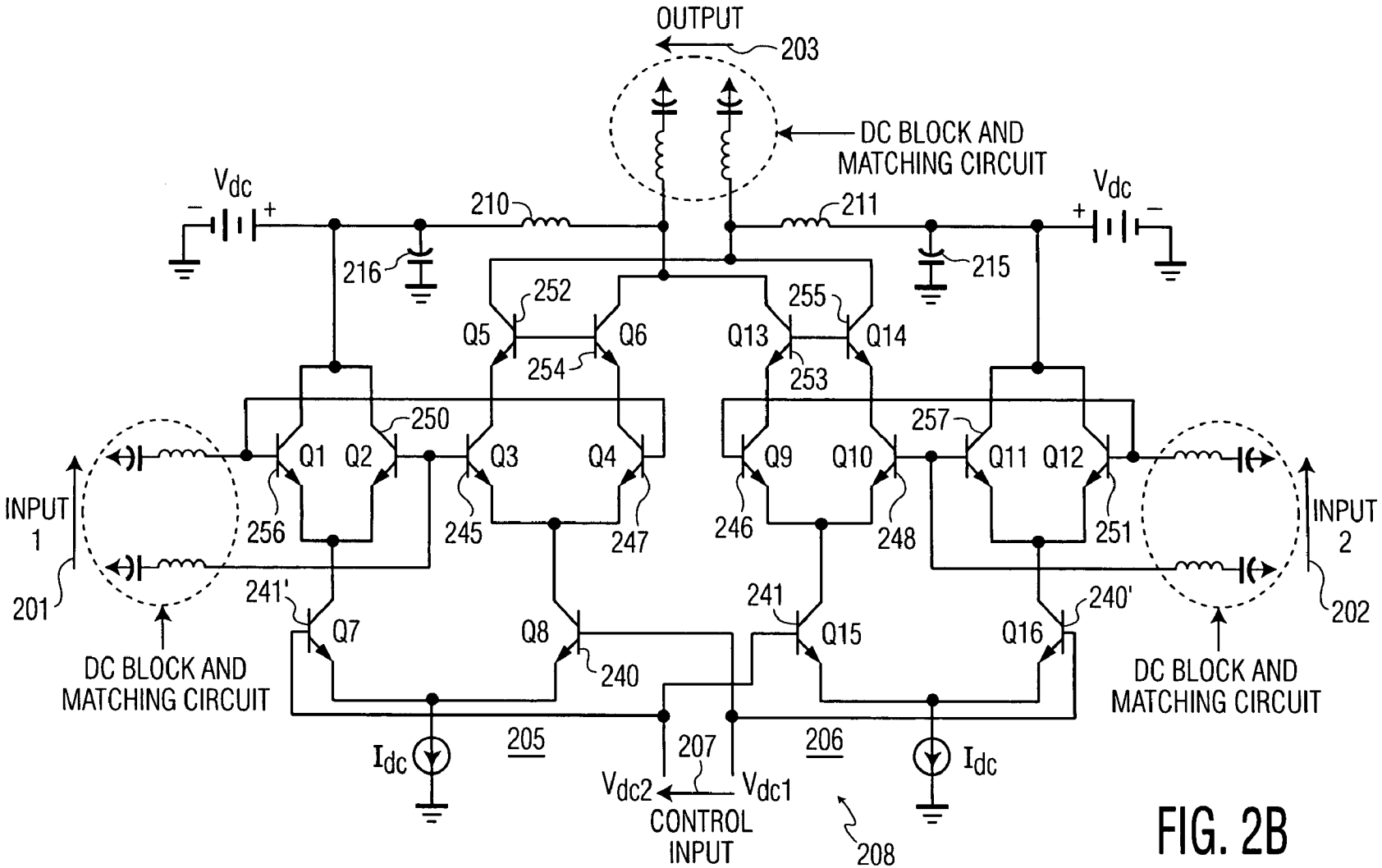
Figure 3A:
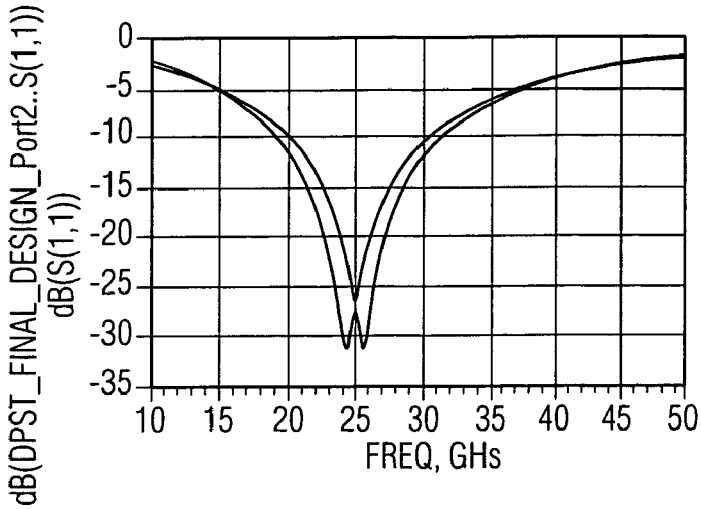
FIGS. 3(*a*)-3(*i*) are graphs showing a frequency versus decibel (dB) response for the switch circuit of FIG. 2 in various states.
Figure 3B:
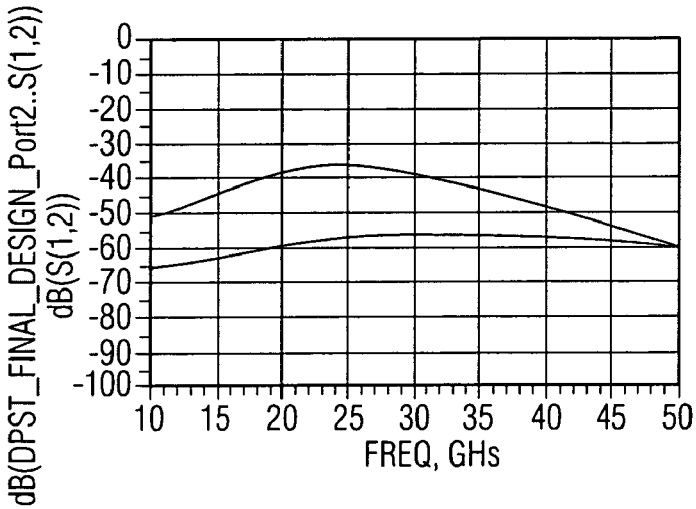
Figure 3C:
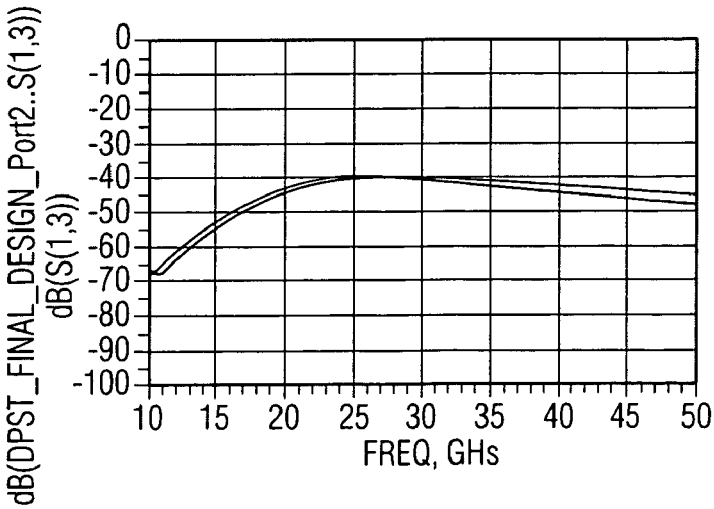
Figure 3D:
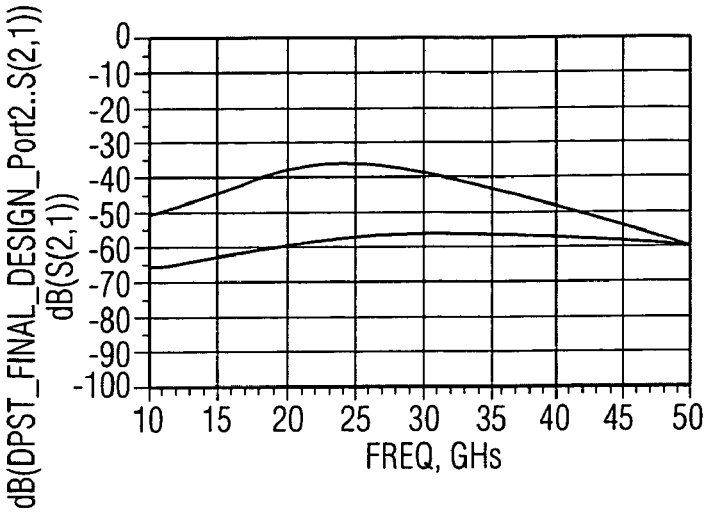
Figure 3E:
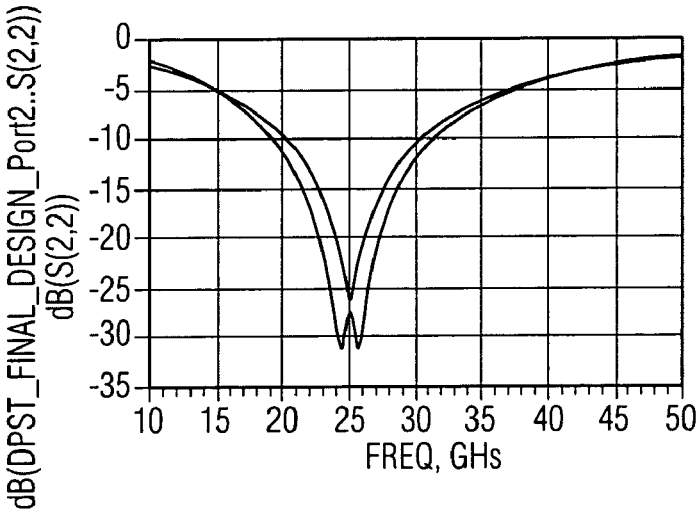
Figure 3F:
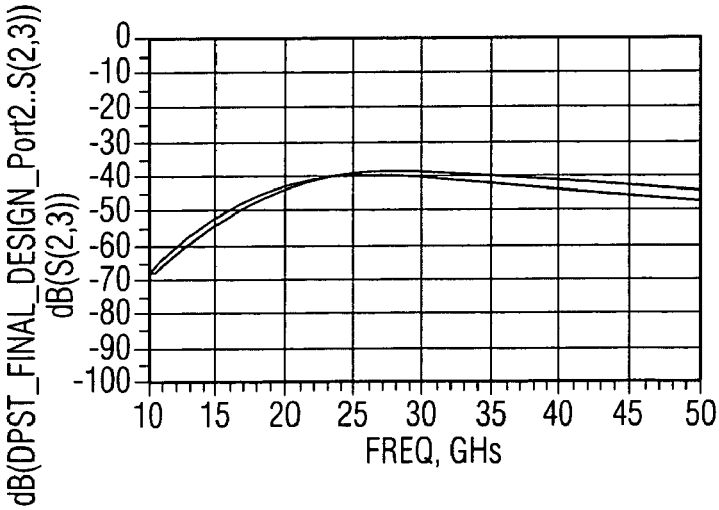
Figure 3G:
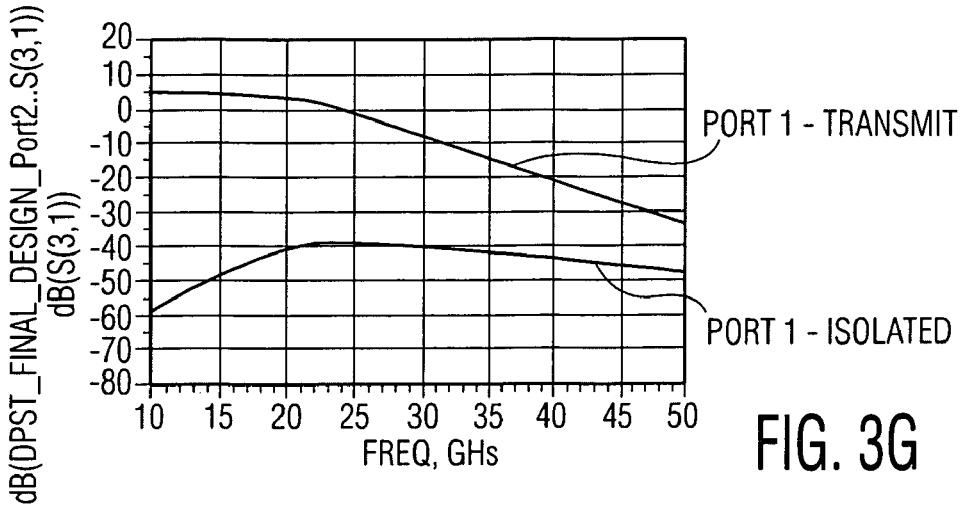
Figure 3H:
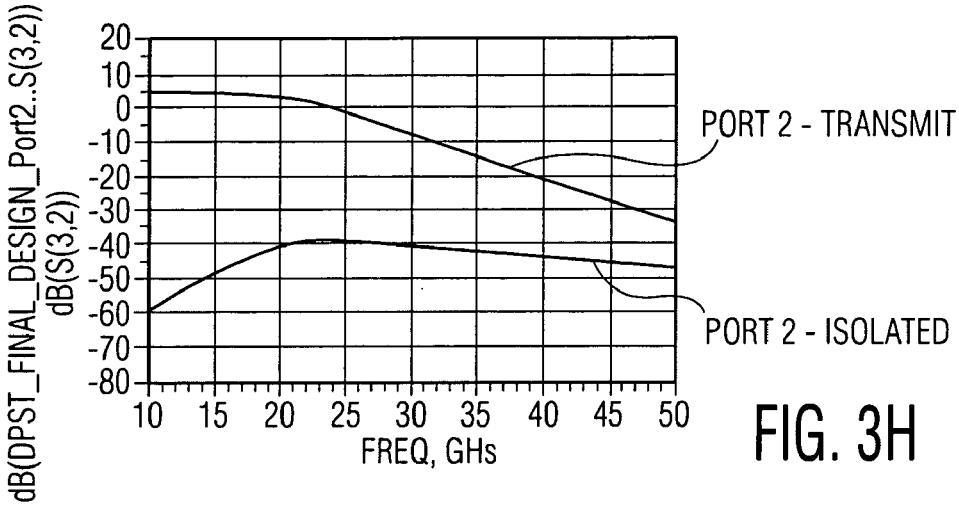
Figure 3I:
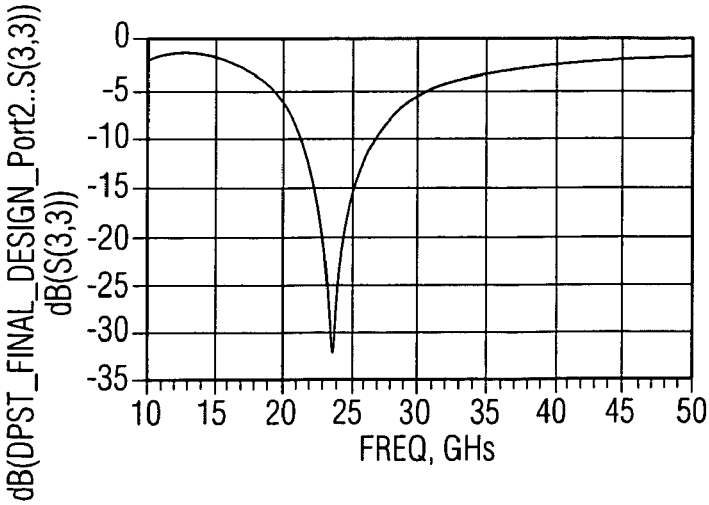

FIG. 2(*a*) shows a DPST switch circuit 200 according to a first exemplary embodiment of the present invention. The DPST switch circuit 200 includes a first input port 201, a second input port 202, and a first output port 203. The switch circuit 200 also includes a first switch section 205 corresponding to the first input port 201, and a second switch section 206 corresponding to the second input port 202. A control input port 207 provides a voltage signal controlling which of the switch sections 205, 206 are active (i.e., transmitting their signal to the output port 203).

The first switch section 205 includes transistors 240, 241', 245, 247, 250, 252, 254, and 256, and the second switch section 206 includes transistors 241, 240', 246, 248, 251, 253, 255, and 257. In Operation, a control voltage is applied to control input port 207 such that the voltage applied to the base of either transistors 240 and 240' (Q8, Q16) or transistors 241 and 241' (Q7, Q15) is higher than the voltage applied to the other set of transistors by the thermal breakdown voltage of the transistors (e.g., 0.7 Volts(V)). For example, if the voltage applied to transistors 240, 240' is greater than the voltage applied to the transistors 241, 241', transistors 240, 240' are biased 'ON' and the first input port 201 'sees' a high input impedance, and thus the signal at the second input port 202 is transmitted to the output port 203. Similarly, if the voltage applied to transistors 241, 241' is greater than the voltage applied to the transistors 240, 240', transistors 241, 241'are biased 'ON' and the second input port 202 'sees' a high input impedance, and thus the signal at the first input port 201 is transmitted to the output port 203.

In the case where first input port 201 is coupled to output port 203 (e.g., where transistors 240 and 240' are biased 'ON'), transistors 251 and 257 (Q11, Q12) are also biased 'ON' and transistors 246, 248, 253 and 255 (Q9, Q10, Q13, Q14) are biased "OFF" so that the second section 206 doesn't load the output of the first switch section 205 at all, and all of the signal transmitted from the first input port 201 will appear at the output port 203. Alternatively, in the case where second input port 202 is coupled to output port 203 (e.g., where transistors 241 and 241'are biased 'ON'), transistors 250 and 256 (Q1, Q2) are also biased 'ON' and transistors 245, 247, 252 and 254 (Q3, Q4, Q5, Q6) are biased "OFF" so that the first section 205 doesn't load the output of the second switch section 206 at all, and all of the signal transmitted from the second input port 202 will appear at the output port 203. Further details of the operation of the switch circuit 200 are discussed below with reference to FIG. 2(*b*).

FIG. 2(*b*) shows the DPST switch circuit 200 according to a first exemplary embodiment of the present invention in greater detail. Many of the elements shown in FIG. 2(*b*) were also shown in FIG. 2(*a*), and like reference numerals indicate like elements. As explained above, the DPST switch circuit 200 includes a first input port 201, a second input port 202, and a first output port 203. A supply voltage $V_{dc}$ is provided to a network of transistor switches 208 (comprised of first section 205 and second section 206) coupled between the inputs 201, 202 and the output 203. Inductors 210, 211 provide isolation between the DC supply voltage $V_{dc}$ and the AC voltage at the input ports 201, 202 and output port 203. Similarly, capacitors 215, 216 isolate DC voltages from the output port 203.

In accordance with the first exemplary embodiment of the present invention, a portion of the network of transistor switches 208 is laid out similarly to the above-described Gilbert Cell. In particular, the network includes bias transistors 240, 240', 241, and 241' (corresponding to bias transistors 130, 140 of the Gilbert Cell shown in FIG. 4), interior transistors 245, 246 (corresponding to transistors 112, 121 of the Gilbert Cell shown in FIG. 4), and exterior transistors 247, 248 (corresponding to transistors 111, 122 of the Gilbert Cell shown in FIG. 4). However, instead of interior transistors 245, 246 having their bases coupled together they are decoupled. Further, additional transistors 250-257 are provided around the 'modified' Gilbert Cell. For ease of illustration, not all of the biasing circuitry for each of the transistors 240, 240', 241, 241', 245-248 and 250-257 is shown in FIG. 2(*b*).

Bias transistors 240 and 241', and 241 and 240', have their emitters coupled together and to a current source $I_{dc}$. The bases of the bias transistors 240, 240' are fed by a first voltage source $V_{dc1}$ and the bases of bias transistors 241, 241' are fed by a second voltage source $V_{dc2}$.

It will be noted that transistor pairs 250/256, 245/247, 246/248, and 251/257 of the switch circuit 200 are all coupled in a 'cascode' configuration (i.e., emitter coupled). This cascode coupling of the transistors presents a high input impedance to each of the input ports 201 and 202. In particular, when input port 201 is applied to the output port 203, input port 202 presents a high input impedance, and when input port 202 is applied to the output port 203, input port 201 presents a high input impedance. The high input impedance prevents either of the unwanted ports (e.g., either input port 201 or 202) from loading the desired signal path. The cascode configuration of the transistor pairs 250/256, 245/247, 246/248, and 251/257 has little or no effect on the isolation between wanted and unwanted signals. It does, however, ensure that the wanted signal is directed to the output port 203 instead of being lost traveling to the other input port.

This high input impedance prevents extraneous signals from the unselected input port from being applied to the switch circuit 200.

Each of the two input ports 201, 202 is coupled to a separate portion of the network of transistors 208. For example, input port 201 is coupled to a first portion 205 including transistors 240, 241', 245, 247, 250, 252, 254 and 256, and input port 202 is coupled to a second portion 206 including transistors 240', 241, 246, 248, 251, 253, 255 and 257. Each of the these first and second portions 205, 206 further include both a 'transmit' channel and an 'isolation' channel. For example, the 'transmit' channel for the first portion 205 (corresponding to input port 201) comprises transistors 245, 247, 252 and 254, and the 'isolation' channel comprises transistors 250 and 256. Similarly, the 'transmit' channel for the second portion 206 (corresponding to input port 202) comprises transistors 246, 248, 253 and 255, and the 'isolation' channel comprises transistors 251 and 257.

In operation, signals are applied to input ports 201 and 202, and either the input signal at port 201 or the input signal at port 202 is transmitted to the output port 203 at any given instant. The selection of which input port (e.g., 201 or 202) is applied to the output port 203 is accomplished by applying different voltages to the bases of bias transistors 240, 240', 241, and 241'. As will be understood by those skilled in the art, voltage sources $V_{dc1}$ and $V_{dc2}$ directly control the voltage applied to the respective bases of the bias transistor 240, 240', 241, and 241'. For example, if bias transistors 240 and 240' have a greater voltage applied thereto than bias transistors 241 and 241' (by at least approximately 0.7 volts, which is the thermal breakdown voltage of the bias transistors), input port 201 will be coupled to output port 203. Similarly, if bias transistors 241 and 241' have a greater voltage applied thereto than bias transistors 240 and 240' (by at least approximately 0.7 volts), input port 202 will be coupled to output port 203.

FIG. 3 shows the switch circuit 200 of FIG. 2 implemented monolithically. FIG. 4 is an enlarged view of a portion of the monolithically-implemented switch circuit 200 showing the input ports 201, 202, and the output port 203 in greater detail. It should be noted that the switch circuit 200 of FIG. 2 may also be implemented monolithically.

FIGS. 3(*a*)-3(*i*) are graphs showing a frequency in GigaHertz (GHz) versus decibel (dB) response for the switch circuit 200 of FIG. 2. In particular, FIGS. 3(*a*), (*e*) and (*i*) show input impedance matching curves for input ports 201 (Port 1), 202 (Port 2) and output port 203 (Port 3), respectively. The remaining figures show isolation curves for the switch circuit 200 as between different ports (e.g., FIG. 3(*b*) shows an isolation curve between one of the input ports (Port 2) and another of the input ports (Port 1). As will be recognized by those skilled in the art, the isolation between the ports 201-203 of the switch circuit 200 is relatively uniform across the operational frequency range. As will be noted by those of ordinary skill in the art, the switch circuit 200 is always matched (i.e., the return loss of each port 201-203 stays constant irrespective of the switch's state).

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention.

What is claimed is:

1. A switch circuit comprising:

a first circuit portion corresponding to a first input port;

a second circuit portion corresponding to a second input port; and an output port, wherein each of the first and second circuit portions include at least two first transistors providing a portion of an isolation channel, at least one second transistor providing a portion of a transmit channel, and at least two third transistors for providing a control bias for selecting either the transmit channel or the isolation channel; and wherein the collectors of the first transistors of the first circuit portion are directly coupled, the collectors of the first transistors of the second circuit portion are directly coupled, and each third transistor of the first circuit portion is coupled at its base directly to a base of a corresponding third transistor of the second circuit portion, and to a control voltage source.

2. The switch circuit of claim 1, wherein the circuit is formed as an integrated circuit.

3. The switch circuit of claim 1, wherein the at least two third transistors of each of the first and second circuit portions provides a control bias for selecting which of the first and second input ports are coupled to the output port.

4. The switch circuit of claim 1, wherein the at least one first transistor comprises two transistors and the at least one second transistor comprises two transistors.

5. The switch circuit of claim 1, wherein the at least one second transistor comprises three transistors.

6. The switch circuit of claim 1, wherein respective emitters of the at least one first transistor and the at least one second transistor are coupled to each other.

7. The switch circuit of claim 6, wherein the respective emitters of the at least one first transistor and the at least one second transistor are additionally coupled to a collector of a respective third transistor.

8. The switch circuit of claim 1, wherein the circuit is formed as an integrated circuit and the at least two third transistors of each of the first and second circuit portions provides a control bias for selecting which of the first and second input ports are coupled to the output port, and the at least one first transistor comprises two transistors and the at least one second transistor comprises two transistors.

9. The switch circuit of claim 1, wherein the at least one second transistor comprises three transistors, and the respective emitters of the at least one first transistor and three second transistors are coupled to each other.

10. A method for providing isolation between at least two inputs and an output of a switch circuit comprising the steps of:

providing a first channel for each of the at least two inputs including at least one first differential amplifier pair, said first channel providing isolation between the at least two inputs and the output of the switch circuit;

providing a second channel for each of the at least two inputs including at least one second differential amplifier pair, said second channel providing coupling between one of the at least two inputs and the output of the circuit; and providing a control bias which selects one of the at least two inputs and a respective first channel or second channel, said control bias comprising at least one biasing transistor corresponding to a first input port coupled at its base directly to a base of at least one second biasing transistor corresponding to a second input port.

* * * * *